US010451287B2

(12) United States Patent
Park et al.

(10) Patent No.: US 10,451,287 B2
(45) Date of Patent: Oct. 22, 2019

(54) BURNER

(71) Applicant: LG ELECTRONICS INC., Seoul (KR)

(72) Inventors: Janghee Park, Seoul (KR); Yongki Jeong, Seoul (KR); Jaebeom Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 592 days.

(21) Appl. No.: 14/869,306

(22) Filed: Sep. 29, 2015

(65) Prior Publication Data

US 2016/0178211 A1 Jun. 23, 2016

(30) Foreign Application Priority Data

Dec. 17, 2014 (KR) ..... 10-2014-0182330

(51) Int. Cl.
*F24C 3/08* (2006.01)
*F23D 14/06* (2006.01)
*F24C 3/10* (2006.01)

(52) U.S. Cl.
CPC ..... *F24C 3/085* (2013.01); *F23D 14/06* (2013.01); *F23D 2900/14062* (2013.01); *F24C 3/103* (2013.01)

(58) Field of Classification Search
CPC ..... F23D 14/84; F23D 14/06; F24C 3/085; F24C 3/08
USPC ..... 126/39 E
See application file for complete search history.

(56) References Cited

U.S. PATENT DOCUMENTS 4,266,930 A * 5/1981 Leonard ..... F23N 5/24 126/41 R
5,160,256 A * 11/1992 Riehl ..... F24C 3/103 126/39 BA
5,934,896 A * 8/1999 Kwiatek ..... F24C 3/103 431/264
2009/0165777 A1* 7/2009 Cadima ..... F23D 14/06 126/39 E
2010/0206293 A1* 8/2010 Padgett ..... F23D 14/06 126/39 E
2011/0143295 A1* 6/2011 Fowler ..... F23D 14/06 431/285
2011/0151385 A1* 6/2011 Lona Santoyo ..... F23D 14/06 431/2
2012/0282560 A1* 11/2012 Cadima ..... F23Q 3/008 431/258
2014/0116417 A1* 5/2014 Dora ..... F23D 14/56 126/39 E

* cited by examiner

*Primary Examiner* — Kenneth Rinehart
*Assistant Examiner* — Deepak A Deean
(74) *Attorney, Agent, or Firm* — Dentons US LLP

(57) ABSTRACT

A burner including a burner head configured to receive a mixed gas; and a burner cap configured to cover the burner head, wherein the burner head includes an outer wall having first flame holes at which a flame is generated, an inner wall having second flame holes at which a flame is generated, and a flame spread passage configured to spread a flame between the inner wall and the outer wall, and a staying guide configured to cause the mixed gas supplied into the flame spread passage to be stayed in the flame spread passage.

7 Claims, 8 Drawing Sheets

BURNER

CROSS-REFERENCE TO RELATED APPLICATION(S)

This application claims priority under 35 U.S.C. § 119 to Korean Application No. 10-2014-0182330, filed in Korea on Dec. 17, 2014, whose entire disclosure is hereby incorporated by reference.

BACKGROUND

1. Field

A burner is disclosed herein.

2. Background

FIG. 8 is a perspective view of a burner according to the related art.

Referring to FIG. 8, a burner according to the related art includes a burner head 50 having a plurality of flame holes, and burner caps 61 and 62 which cover the burner head 50.

The burner head 50 includes an outer burner head 52, and an inner burner head 53 which is located at an inside of the outer burner head 52.

The burner caps 61 and 62 includes an outer cap 61 which covers an upper side of the outer burner head 52, and an inner cap 62 which covers the inner burner head 53.

In the case of such a burner, a flame should be spread between the outer burner head 52 and the inner burner head 53.

In the case of the burner according to the related art, a slit 63 which forms a flame spread passage may be provided at the outer cap 61 to spread the flame between the outer burner head 52 and the inner burner head 53.

A mixed gas in which air and a gas are mixed may exist in the slit 63, and thus, when the flame in one of the outer burner head 52 and the inner burner head 53 is extinguished, the flame may be generated again by receiving the flame of the other burner head.

However, according to the burner in the related art, the slit may be clogged with food or slop in the process of using the burner. In this case, there is a problem in that it is impossible to spread the flame through the slit.

In this case, there is another problem in that the unburned mixed gas leaks from one of the outer burner head 52 and the inner burner head 53.

SUMMARY

The present disclosure is directed to a burner which is capable of smoothly spreading a flame.

According to an aspect of the present disclosure, there is provided a burner including a burner head configured to receive a mixed gas; and a burner cap configured to cover the burner head, wherein the burner head includes an outer wall having first flame holes at which a flame is generated, an inner wall having second flame holes at which a flame is generated, and a flame spread passage configured to spread a flame between the inner wall and the outer wall, and a staying guide configured to cause the mixed gas supplied into the flame spread passage to be stayed in the flame spread passage.

The details of one or more embodiments are set forth in the accompanying drawings and the description below. Other features will be apparent from the description and drawings, and from the claims.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
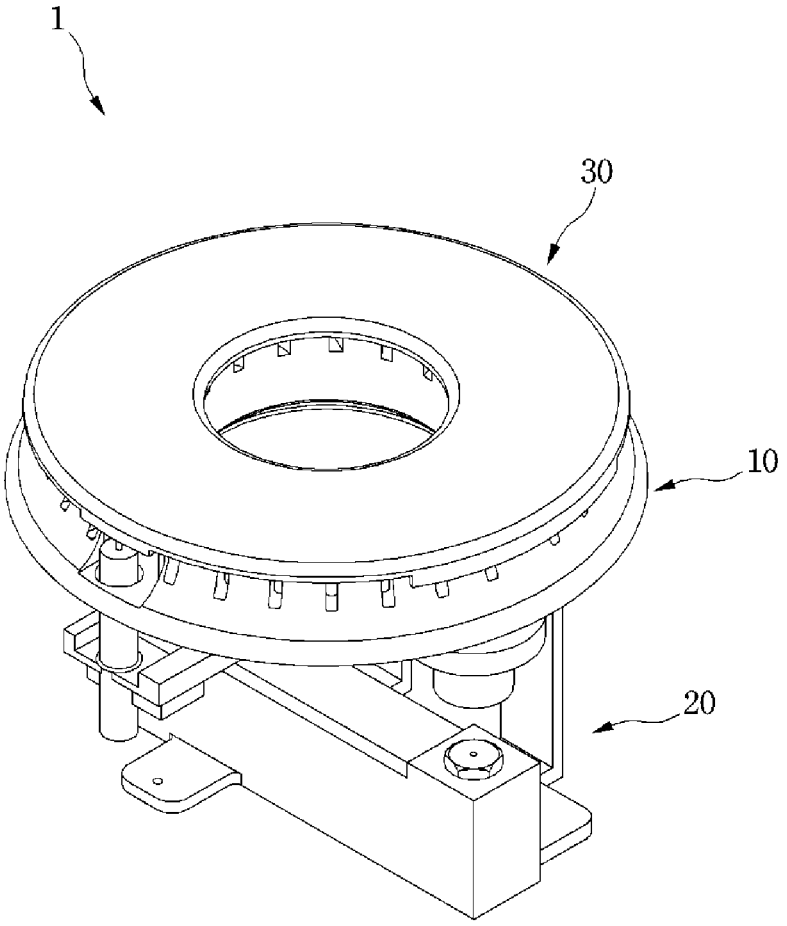
FIG. 1 is a perspective view of a burner according to a first embodiment of the present disclosure.
Figure 2:
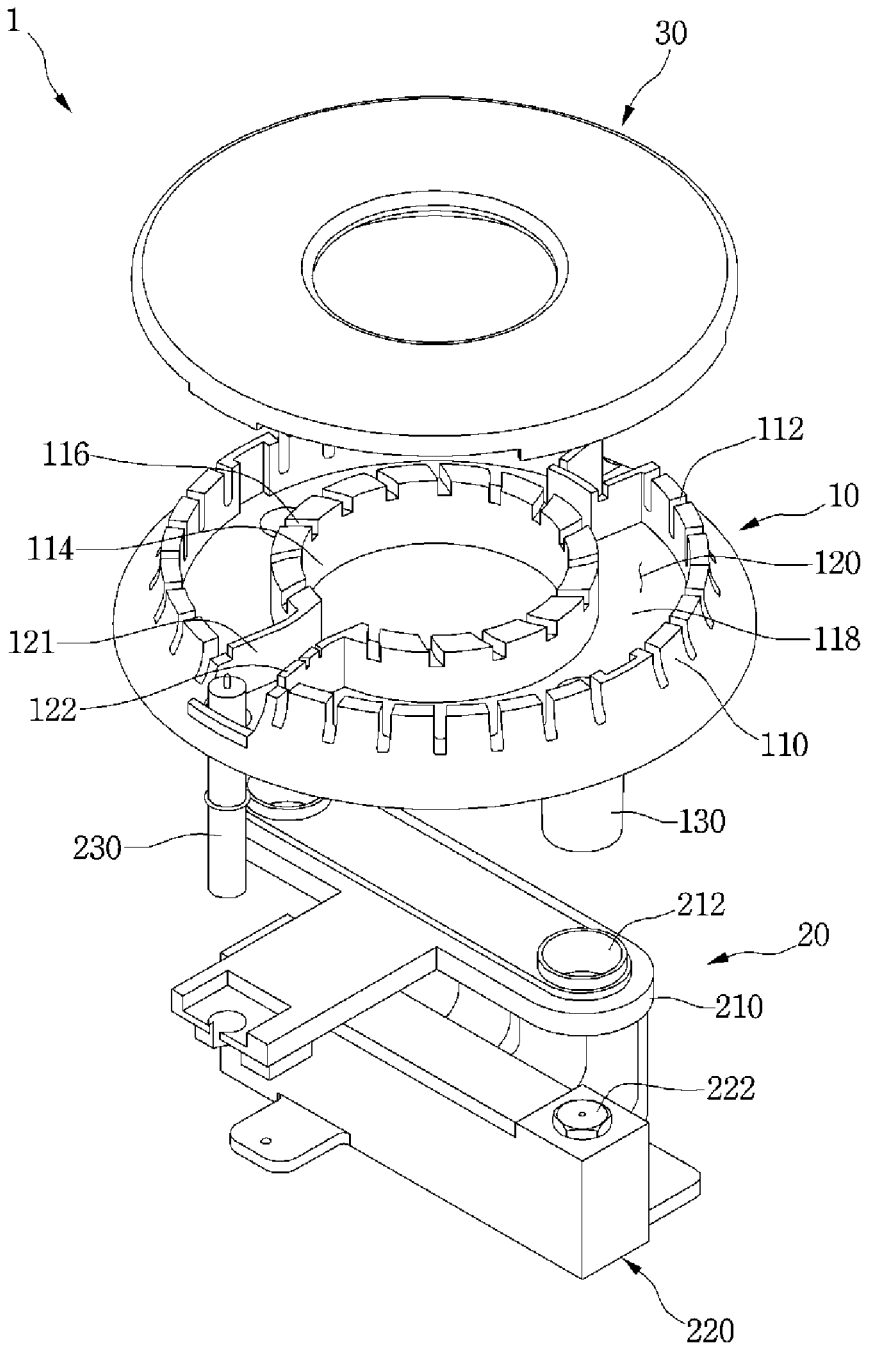
FIG. 2 is an exploded perspective view of the burner of FIG. 1.

FIG. 1 is a perspective view of a burner according to a first embodiment of the present disclosure, and FIG. 2 is an exploded perspective view of the burner of FIG. 1.

Referring to FIGS. 1 and 2, a burner 1 according to the first embodiment of the present disclosure may include a burner head 10 having a plurality of flame holes through which a flame is discharged, and a burner body 20 which supports the burner head 10, and a burner cap 30 which is seated on an upper side of the burner head 10.

The burner 1 may further include an ignition part 230 which ignites a mixed gas of air and a gas supplied to the burner head 10.

A burner body 20 may include a head support part 210 which supports the burner head 10, and a gas supply part 220 which is connected with the head support part 210.

The head support part 210 may include an opening 212 through which mixed gas supply pipes 130 and 131 (referring to FIG. 3) of the burner head 10 may pass.

The gas supply part 220 may receive the gas and may supply the gas to the burner head 10. The gas supply part 220 may have a plurality of nozzles 222.

Also, the gas supply part 220 may support the ignition part 230.

Figure 3:
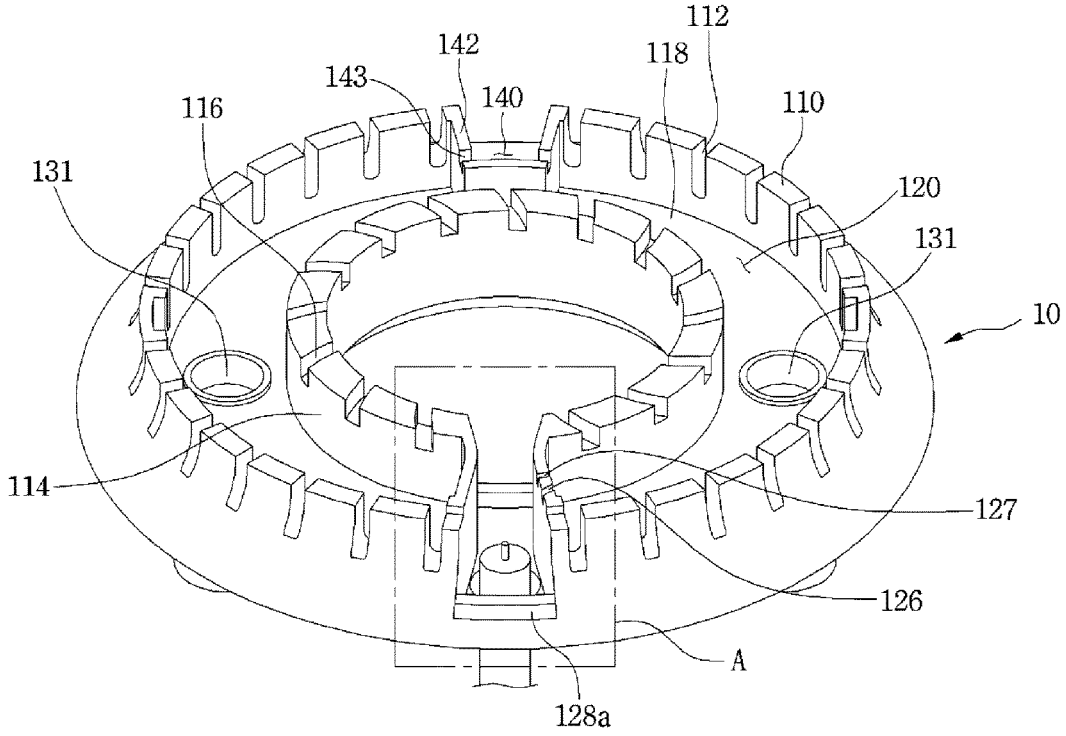
FIG. 3 is a perspective view of a burner head according to a first embodiment of the present disclosure.
Figure 4:
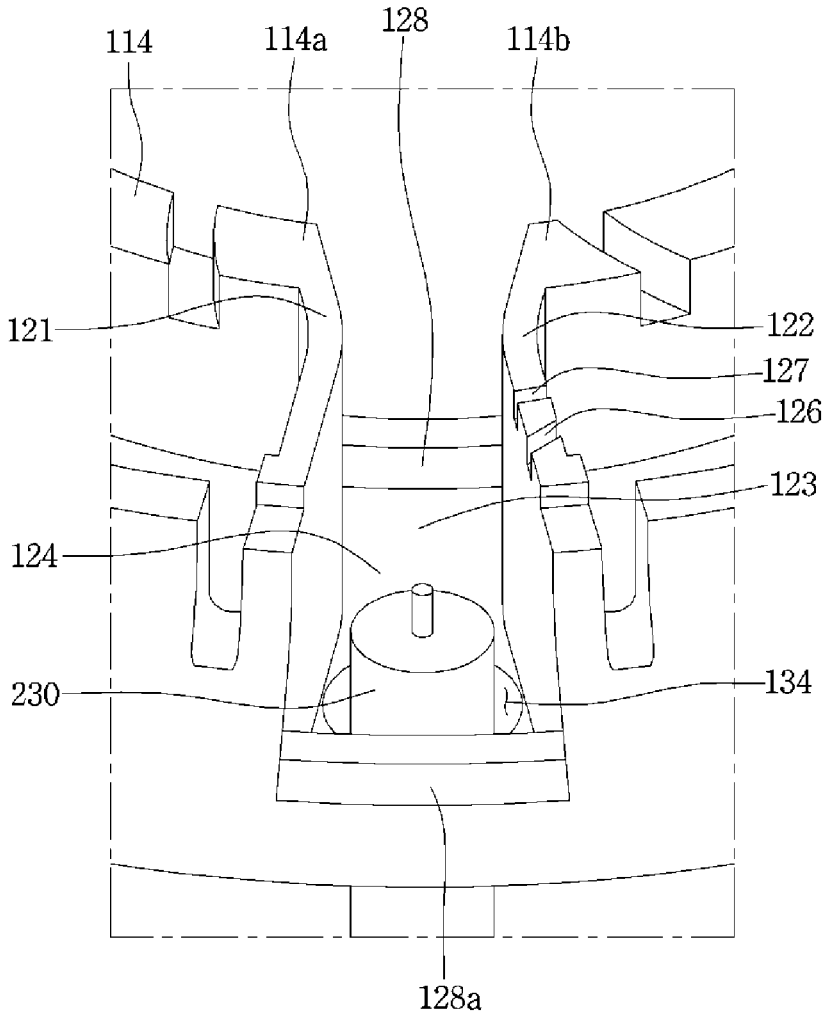
FIG. 4 is an enlarged view of a portion A of FIG. 3.
Figure 5:
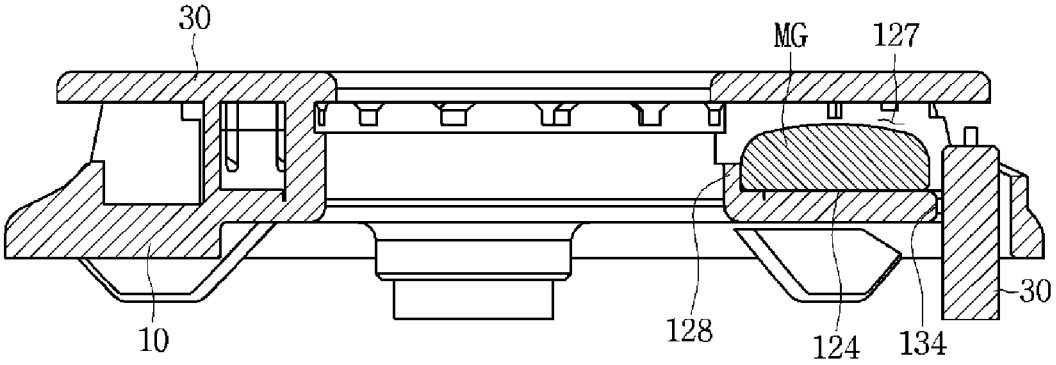
FIG. 5 is a cross-sectional view illustrating a state in which a burner cap is seated on the burner head according to a first embodiment of the present disclosure.

FIG. 3 is a perspective view of the burner head according to the first embodiment of the present disclosure, and FIG. 4 is an enlarged view of a portion A of FIG. 3, and FIG. 5 is a cross-sectional view illustrating a state in which the burner cap 30 is seated on the burner head 10 according to the first embodiment of the present disclosure.

Referring to FIGS. 2 to 5, the burner head 10 according to the first embodiment of the present disclosure may include an outer wall 110 (which may be referred to as a "first wall"), and an inner wall 114 (which may be referred to as a "second wall") which is spaced from the outer wall 110 toward an inside of the outer wall 110.

The outer wall 110 may include a plurality of first flame holes 112 through which the flame is discharged. The plurality of first flame holes 112 may be disposed to be spaced in a circumferential direction of the outer wall 110.

The inner wall 114 may include a plurality of second flame holes 116 through which the flame is discharged. The plurality of second flame holes 116 may be disposed to be spaced in a circumferential direction of the inner wall 114.

The burner head 10 may further include a bottom wall 118 which forms a mixed gas chamber 120 together with the outer wall 110 and the inner wall 114.

The burner cap 30 may be seated on the outer wall 110 and the inner wall 114. And the burner cap 30 may cover the mixed gas chamber 120. At this time, the burner cap 30 may include an opening so that the flame generated at the inner wall 114 passes through the burner cap 30. For example, the opening may be formed at a center portion of the burner cap 30.

One or more mixed gas supply pipes 130 and 131 through which the mixed gas is supplied may be connected to the bottom wall 118. The mixed gas supply pipes 130 and 131 may be integrally formed with the bottom wall 118, or may be separately formed from the bottom wall 118 and then may be coupled to the bottom wall 118.

As an example, it is illustrated in FIG. 3 that two mixed gas supply pipes 130 and 131 are connected to the bottom wall 118.

The mixed gas supply pipes 130 and 131 may pass through the opening 212 formed at the head support part 210 of the burner body 20. While the burner head 10 is seated on the head support part 210 of the burner body 20, the mixed gas supply pipes 130 and 131 are spaced from the nozzles 222 provided at the gas supply part 220.

Therefore, when the gas is sprayed from the nozzles 222, air around the mixed gas supply pipes 130 and 131 is introduced into the mixed gas supply pipes 130 and 131 together with the gas.

The outer wall 110 and the inner wall 114 may be connected by a plurality of connection walls 121 and 122.

The outer wall 110 and the inner wall 114 may be formed to have an approximately "C" shape, and an end of the inner wall 114 and an end of the outer wall 110 may be connected by the plurality of connection walls 121 and 122.

The plurality of connection walls 121 and 122 may include a first connection wall 121 and a second connection wall 122 which is spaced from the first connection wall 121.

The first connection wall 121 may connect one end of the outer wall 110 with one end of the inner wall 114. The second connection wall 122 may connect the other end of the outer wall 110 with the other end of the inner wall 114. Therefore, the mixed gas chamber 120 may also be formed to have an approximately "C" shape.

The first connection wall 121 and the second connection wall 122 are disposed to be spaced a predetermined distance from each other, and thus form a flame spread passage 123 for spreading the flame.

The flame spread passage 123 may spread the flame of the outer wall 110 toward the inner wall 114, or may spread the flame of the inner wall 114 toward the outer wall 110.

The burner head 10 may further include a passage bottom wall 124 for forming a bottom of the flame spread passage 123.

An ignition part through-hole 134 through which the ignition part 230 passes may be formed at the passage bottom wall 124.

At least one of the first connection wall 121 and the second connection wall 122 may include an ignition flame hole 126 which supplies the mixed gas to the ignition part 230. The ignition flame hole 126 may be disposed at least one of the first connection wall 121 and the second connection wall 122 to be inclined toward the ignition part 230.

Since the ignition flame hole 126 is disposed to be inclined toward the ignition part 230, the mixed gas is supplied to the ignition part 230 when an igniting operation is performed by the ignition part 230, the igniting operation is rapidly and smoothly performed.

At least one of the first and second connection walls 121 and 122 may include a flame spread hole 127 which supplies the mixed gas MG to be stayed in the flame spread passage 123. The flame spread hole 127 may be located closer to the inner wall 114 than the ignition flame hole 126.

The burner head 10 may further include a staying guide 128 which allows the mixed gas MG supplied to the flame spread passage 123 to be stayed in the flame spread passage 123.

The staying guide 128 may extend upward from the passage bottom wall 124. That is, the staying guide 128 may extend from the passage bottom wall 124 toward the burner cap 30. An upper surface of the staying guide 128 may be located higher than the passage bottom wall 124.

The staying guide 128 may minimize the flow of the mixed gas in the flame spread passage 123 into an inner space of the inner wall 114.

To spread the flame between the outer wall 110 and the inner wall 114, the staying guide 128 may connect a first end 114*a* and a second end 114*b* of the inner wall 114. That is, the both ends of the inner wall 114 are spaced from each other, and the staying guide 128 may connects the both ends of the inner wall 114.

Therefore, by the staying guide 128, the mixed gas MG supplied into the flame spread passage 123 may be stayed in the flame spread passage 123, and thus the flame may be smoothly spread between the outer wall 110 and the inner wall 114.

According to the embodiment, even when a calorific value (a quantity of heat which can be provided by the burner) of the burner 1 is small as well as when the calorific value is great, the mixed gas MG may be stayed in the flame spread passage 123, and thus the flame may be smoothly spread between the outer wall 110 and the inner wall 114.

In particular, since the flame is smoothly spread in a state in which the flame of the inner wall 114 and the outer wall 110 is extinguished, the unburned mixed gas is prevented from being discharged to an outside.

As another example, the staying guide 128 may connect the first connection wall 121 with the second connection wall 122. However, to secure a space in the flame spread passage 123, the staying guide 128 may be located adjacent to the inner wall 114.

A height of the staying guide 128 may be lower than that of the inner wall 114. If the height of the staying guide 128 is the same as that of the inner wall 114, the staying guide 128 may effectively prevent the mixed gas in the flame spread passage 123 from being discharged to the inner space of the inner wall 114, but the mixed gas in the flame spread passage 123 does not meet the flame of the inner wall 114. Therefore, the flame is not spread to the outer wall 110, and thus it is not preferable (when the flame of the outer wall is extinguished).

Also, when the height of the staying guide 128 is the same as that of the inner wall 114, the flame of the flame spread passage 123 does not meet with the mixed gas discharged from the second flame holes 116 of the inner wall 114. Therefore, the flame is not spread to the inner wall 114, and thus it is not preferable (when the flame of the inner wall is extinguished).

Also, when the height of the staying guide 128 is higher than that of the inner wall 114, it is difficult to seat the burner cap 30 on the inner wall 114, or a part of the burner cap 30 is spaced from the inner wall 114.

That is, it is preferable that the staying guide 128 be spaced from a lower surface of the burner cap 30, while the burner cap 30 is seated on the burner head 10.

Meanwhile, at least a part of the ignition part 230 may be located between the first connection wall 121 and the second connection wall 122, while passing through the ignition part through-hole 134.

Since at least a part of the ignition part 230 is located between the first connection wall 121 and the second connection wall 122, the ignition part 230 serves as a wall which prevents the mixed gas in the flame spread passage 123 from flowing to an outside of the outer wall 110, the mixed gas MG supplied into the flame spread passage 123 may be stayed in the flame spread passage 123.

However, a location of the ignition part 230 may be changed, if the ignition part 230 is not located between the first connection wall 121 and the second connection wall 122, the burner head 10 may further include a staying guide configured to prevent the mixed gas in the flame spread passage 123 from being discharged to the outside of the outer wall 110.

In this case, a staying guide adjacent to the inner wall 114 may be an inner guide, and a staying guide adjacent to the outer wall 110 may be an outer guide. Each of the inside guide and the outside guide may protrude upward from the passage bottom wall 124 and may be spaced a predetermined distance to stay the mixed gas.

Otherwise, when the ignition part 230 is located between the first connection wall 121 and the second connection wall 122, the outer guide **128*a* may be disposed at a position adjacent to the outer wall 110**.

Meanwhile, the burner head 10 may further include a flame staying chamber 140 which provides a space allowing the flame to be stayed therein.

The flame staying chamber 140 may be formed by recessing a part (hereinafter, call a "chamber defining wall") of the outer wall 110 toward the inner wall 114. One or more slit 143 may be formed at the chamber defining wall 142.

By the flame staying chamber 140, the flame may be stayed in the flame staying chamber 140, even though the flame of the outer wall 110 and the inner wall 114 is extinguished while the burner 1 is used, and thus the mixed gas in the outer wall 110 and the inner wall 114 may be reignited by the flame in the flame staying chamber 140, thereby generating the flame.

In particular, when the burner 1 is used while being installed at a gas oven range, or the gas oven range is used in a built-in state, the flame of the inner wall 114 and the outer wall 110 of the burner 1 may be extinguished while an oven door of the gas oven range is opened and closed.

Even in this case, the mixed gas in the outer wall 110 and the inner wall 114 may be reignited by the flame in the flame staying chamber 140, and thus the flame may be generated.

At this time, the flame may be generated at the outer wall 110 by the flame in the flame staying chamber 140, and the flame generated from the outer wall 110 is transferred to the flame spread passage 123. As described above, since the mixed gas MG may be stayed in the flame spread passage 123 by the staying guide 128, the flame of the flame spread passage 123 may be smoothly transferred toward the mixed gas discharged from the second flame holes 116 of the inner wall 114, and thus may be spread to the inner wall 114.

Figure 6:
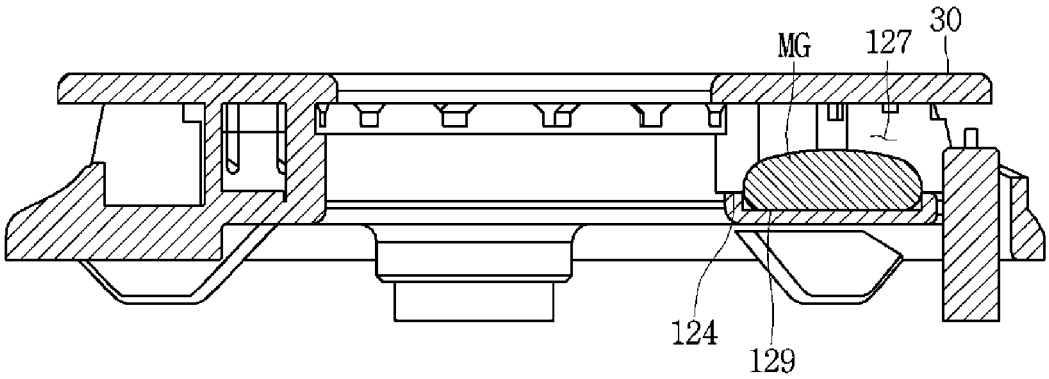
FIG. 6 is a cross-sectional view illustrating a state in which a burner cap is seated on the burner head according to a second embodiment of the present disclosure.

FIG. 6 is a cross-sectional view illustrating a state in which the burner cap 30 is seated on the burner head 10 according to the second embodiment of the present disclosure.

The embodiment has a difference in a structure of the burner head 10 for a flame to stay in the flame spread passage 123, but is the same as the first embodiment in other element. Therefore, hereinafter, only a specific element of the embodiment will be described below.

Referring to FIG. 6, in the burner head 10 according to the second embodiment of the present disclosure, a staying guide 129 defining a space in which a flame may be stayed is provided at a passage bottom wall 124 serving as a bottom of the flame spread passage 123.

The staying guide 129 may be a recess formed when the passage bottom wall 124 is recessed downward.

Since an amount of the mixed gas MG existing in the flame spread passage 123 is increased due to the staying guide 129, the flame may be smoothly spread between the inner wall 114 and the outer wall 110.

Figure 7:
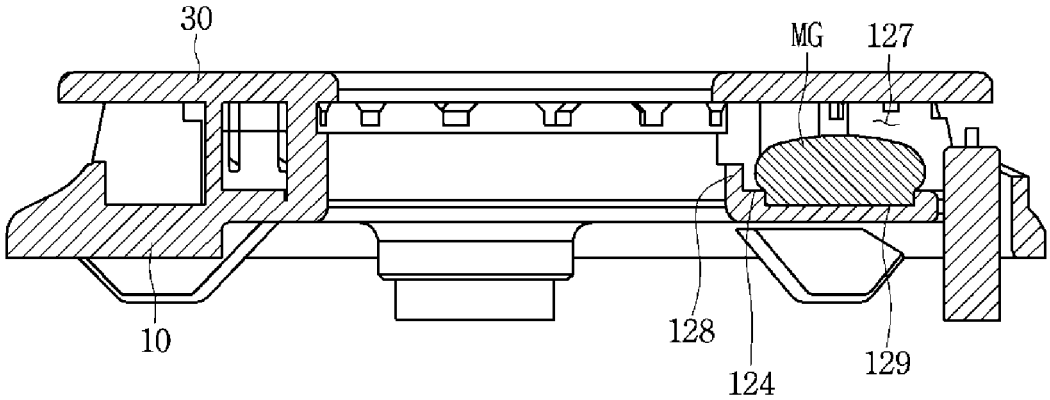
FIG. 7 is a cross-sectional view illustrating a state in which a burner cap is seated on the burner head according to a third embodiment of the present disclosure.
Figure 8:
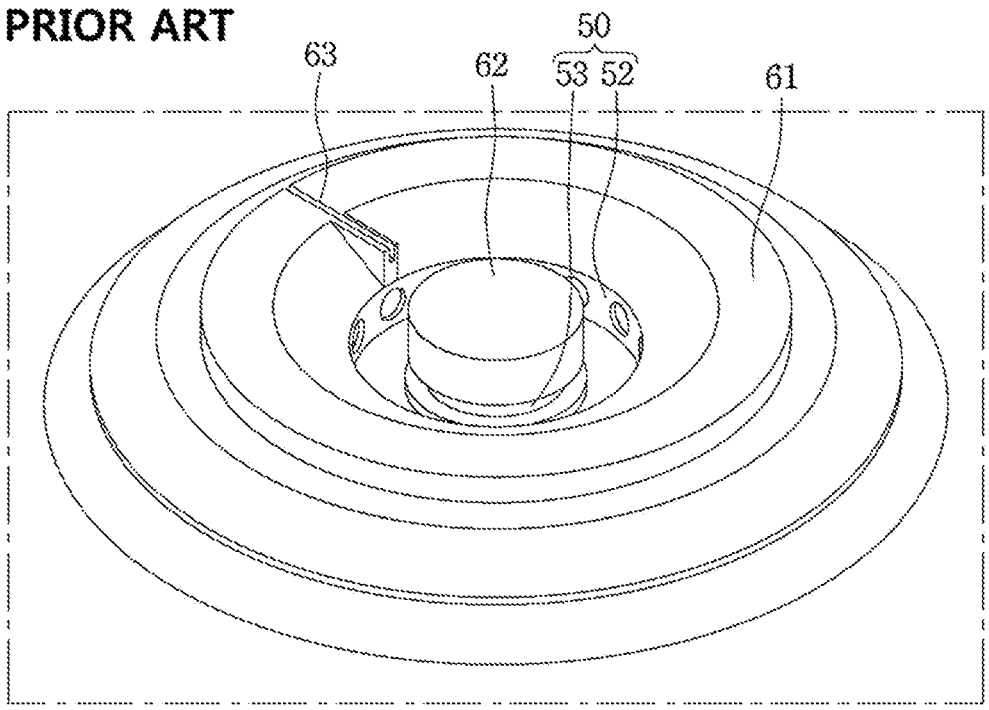
FIG. 8 is a perspective view of a burner according to the related art.

FIG. 7 is a cross-sectional view illustrating a state in which the burner cap 30 is seated on the burner head 10 according to the third embodiment of the present disclosure.

Referring to FIG. 7, the burner head 10 of the embodiment may include both the staying guide 128 of the first embodiment and the staying guide 129 of the second embodiment.

According to the embodiment, even when the mixed gas MG may be stayed in the flame spread passage 123 by the staying guide 128 in a rib shape, as well as an amount of the mixed gas MG stayed in the flame spread passage 123 is increased by the staying guide 129 in a recess shape, the flame may be more smoothly spread between the inner wall 114 and the outer wall 110.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or comprises or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A burner comprising:

a burner head to receive a mixed gas;

a burner cap to cover the burner head, said burner head comprising:

an outer wall having at least one first flame hole at which a flame is generated, an inner wall having at least one second flame hole at which a flame is generated, and a flame spread passage to spread a flame between the inner wall and the outer wall;

an inner staying guide to define a space to hold the mixed gas that is supplied into the flame spread passage; and an ignition part to ignite the mixed gas of the burner head, wherein the burner head further comprises a plurality of connection walls to connect the inner wall with the outer wall, wherein at least a portion of the ignition part is provided between the plurality of connection walls, wherein the burner cap includes an inner periphery surface and an outer periphery surface, wherein a portion of the ignition part faces a region between the inner periphery and the outer periphery of the burner cap, and another portion of the ignition part is disposed outside the outer periphery surface of the burner cap in a horizontal direction.

2. The burner of claim 1, further comprising an outer staying guide to define the space and spaced apart from the inner staying guide, wherein an upper surface of the inner and outer staying guides is provided above a passage bottom wall for forming a bottom surface of the flame spread passage.

3. The burner of claim 2, wherein the inner and outer staying guides protrude from the passage bottom wall toward the burner cap.

4. The burner of claim 3, wherein the inner and outer staying guides are connected to the plurality of connection walls.

5. The burner of claim 1, wherein at least one of the plurality of connection walls comprises:

an ignition flame hole to supply the mixed gas to the ignition part; and a flame spread hole to supply the mixed gas to the flame spread passage.

6. The burner of claim 2, wherein both ends of the inner wall are spaced from each other, and the inner staying guide is connected to the both ends of the inner wall.

7. The burner of claim 2, wherein the inner and outer staying guides are spaced apart from a lower surface of the burner cap when the burner cap is provided on the burner head.

* * * * *